US008051860B1

(12) United States Patent
Pereira

(10) Patent No.: US 8,051,860 B1
(45) Date of Patent: Nov. 8, 2011

(54) EYEBROW MAKEUP APPLICATION DEVICE

(76) Inventor: Suely Pereira, Pompano Beach, FL (US)

( * ) Notice: Subject to any disclaimer, the term of this patent is extended or adjusted under 35 U.S.C. 154(b) by 596 days.

(21) Appl. No.: 12/123,007

(22) Filed: May 19, 2008

Related U.S. Application Data

(60) Provisional application No. 60/944,132, filed on Jun. 15, 2007.

(51) Int. Cl.
*A45D 24/00* (2006.01)
*A45D 40/30* (2006.01)
*B41K 1/56* (2006.01)

(52) U.S. Cl. ..... 132/200; 132/216; 101/405

(58) Field of Classification Search ..... 132/216, 132/200, 201, 218, 317, 318, 319, 320, 333, 132/285, 207; 101/127, 125, 327, 333, 405, 101/406, 483; D28/7; 81/7, 9.2, 9.21, 9.22; 118/76, 200; 401/25, 27, 130, 261, 208; 434/99, 100
See application file for complete search history.

(56) References Cited

U.S. PATENT DOCUMENTS

| | | | | | |
|---|---|---|---|---|---|
| 2,218,862 | A | * | 10/1940 | Vredenburgh | 15/209.1 |
| 2,719,315 | A | * | 10/1955 | Sheehan | 15/210.1 |
| 2,998,821 | A | * | 9/1961 | Hurdel | 132/218 |
| 3,158,096 | A | * | 11/1964 | Arnold | 101/368 |
| 3,557,805 | A | | 1/1971 | Hamada | |
| 3,718,145 | A | | 2/1973 | Chateau | |
| 3,823,723 | A | * | 7/1974 | Miller | 132/201 |
| 4,024,879 | A | | 5/1977 | Stryker | |
| 4,858,631 | A | | 8/1989 | Chuang | |
| 4,887,994 | A | * | 12/1989 | Bedford | 604/1 |
| 4,914,988 | A | | 4/1990 | Chang | |
| 4,924,773 | A | * | 5/1990 | Gwilliam | 101/327 |
| 5,003,659 | A | * | 4/1991 | Paepke | 15/229.13 |
| 5,137,040 | A | * | 8/1992 | Iosilevich et al. | 132/320 |
| 5,186,190 | A | | 2/1993 | Hirzel | |
| D334,399 | S | * | 3/1993 | Ziegler | D19/42 |
| 5,388,700 | A | * | 2/1995 | Per-Lee | 206/581 |
| 5,435,328 | A | * | 7/1995 | Grohoske | 132/120 |
| 5,662,129 | A | | 9/1997 | Grenevitch et al. | |
| 5,671,497 | A | * | 9/1997 | Abdo | 15/144.1 |
| 5,673,455 | A | * | 10/1997 | Per-Lee et al. | 15/210.1 |
| D393,501 | S | | 4/1998 | Galos | |
| 5,741,290 | A | | 4/1998 | Hsieh | |
| 5,860,433 | A | | 1/1999 | Halpern | |
| 5,937,873 | A | * | 8/1999 | Schlosser et al. | 132/320 |
| 6,161,554 | A | | 12/2000 | Dunlap-Harris | |
| D492,343 | S | * | 6/2004 | Zambelli | D18/15 |
| 7,219,674 | B1 | * | 5/2007 | Shelley | 132/319 |
| 7,334,586 | B2 | * | 2/2008 | Pilmanis | 132/320 |
| 7,955,018 | B2 | * | 6/2011 | Abergel | 401/208 |
| 2006/0150994 | A1 | * | 7/2006 | Pilmanis | 132/218 |
| 2006/0249173 | A1 | * | 11/2006 | Lawson | 132/319 |
| 2007/0006748 | A1 | * | 1/2007 | Liu | 101/127 |
| 2009/0151741 | A1 | * | 6/2009 | Ngo | 132/216 |
| 2009/0260567 | A1 | * | 10/2009 | Ozuna et al. | 118/600 |
| 2009/0266377 | A1 | * | 10/2009 | Matsumoto et al. | 132/202 |

* cited by examiner

*Primary Examiner* — Todd Manahan
*Assistant Examiner* — Vanitha Elgart
(74) *Attorney, Agent, or Firm* — Price Heneveld LLP

(57) ABSTRACT

An eyebrow makeup application device includes a handle and an eyebrow-shaped stamp. The handle is preferably configured with a first handle end comprising a first fastening connection and with a grip section. The stamp has a skin-facing front surface configured with the desired eyebrow design. The front surface is configured to contact the cosmetic coloring composition and to retain enough of the composition to imprint the desired eyebrow design onto the eyebrow area. A second fastening connection on the rear base of the stamp is configured to connect the stamp to the handle via the first fastening connection, either permanently or removably.

19 Claims, 5 Drawing Sheets

EYEBROW MAKEUP APPLICATION DEVICE

CROSS-REFERENCE TO RELATED APPLICATION

This application claims the benefit of co-pending U.S. Provisional Application Ser. No. 60/944,132 filed on Jun. 15, 2007, which is incorporated herein in its entirety.

BACKGROUND OF THE INVENTION

1. Field of the Invention

The present invention relates generally to the field of cosmetics, especially in the area of cosmetic eyebrow treatments, and more particularly, but not by way of limitation, to an eyebrow stamp for enhancing the attractiveness of a face by efficiently applying a cosmetic composition of a desired color in a desired eyebrow shape to the eyebrow area.

2. Description of the Prior Art

From the early Japanese geishas, the ancient Romans, and the Bronze Age Egyptians to the modern fashion-conscious woman, cosmetic coloring compositions have been applied to eyebrows to enhance the face. While in ancient times, kohl (a black pigment made from soot or antimony mixed with other ingredients) or a green pigment (malachite, an oxide of copper) were used to manually darken and to shape the eyebrows, today extruded or molded pencils composed of oils, esters, silicones, high melting point triglycerides, stearic acid, synthetic waxes, and colorants are conventionally used.

The great attention paid to the eyebrow is due to the pronounced effect that the eyebrow shape and color has on the overall facial appearance. Not only do current fashion ideals often favor a particular eyebrow style or shape, even the temperament or personality of a person is often perceived differently depending on the eyebrow characteristics. For example, a very light, thin, and indistinct eyebrow may incline the observer to label the person as weak, while a strong, defined, arched eyebrow tends to imply a more assertive personality.

While excellent brows can dramatically enhance the whole face, any one of a variety of circumstances may occur that will result in unsatisfactory or inadequate eyebrows. Over plucking or over tweezing may lead to misshapen eyebrows. With age the eyebrows often grow unruly or become gray and lighter. Fair skinned people with light hair may have extremely light eyebrows that cannot be seen. Also, various medical conditions and treatments may cause the loss of the eyebrow hair.

To address the problem of unsatisfactory eyebrows, generally an eyebrow pencil is used in a free-hand manner to apply a cosmetic coloring composition to attempt to achieve the desired style, to darken and define light eyebrows, to shape eyebrows, to fill in sparse eyebrows, or to compensate for graying eyebrows.

Yet using an eyebrow pencil is not only time consuming, it is also difficult to achieve the desired eyebrow shape, difficult to apply the color with strokes duplicating natural eyebrow hair thickness and positioning, difficult to achieve a symmetrical stoke application on both the right and left eyebrows, and difficult to position the enhanced eyebrows. Therefore, to facilitate the use of the eyebrow pencil, eyebrow templates have been developed. Generally an eyebrow template consists of a device to be positioned over the eyebrow area which has two openings in the desired eyebrow shape. The eyebrow template provides a guide or pattern to allow the user to manually apply the coloring composition of the eyebrow pencil. Such templates may be formed as cut-outs in a band positioned around the forehead with the cut-outs located over the desired eyebrow location. Thus, while a template provides some benefit by showing a desired eyebrow shape, the numerous eyebrow pencil strokes required are still time consuming, symmetry is still hard to achieve, and it is still difficult to apply the color with strokes duplicating natural eyebrow hair thickness and positioning. Additionally, precise positioning is problematic due to the fact that the placement of the band around the forehead obscures part of the face. For optimum positioning of the eyebrow, the user needs to be able to view the entire face, as slight variations in eyebrow positioning are aesthetically significant.

One eyebrow stamp is currently available which attempts to address the problems of time consuming application and of attempting to achieve a natural-looking eyebrow style, placement, and symmetry. The eyebrow stamp currently available consists of a rectangular, transparent acrylic block slightly larger than an eyebrow onto which an eyebrow-shaped polymer design is manually attached and carefully positioned. In use, the eyebrow-shaped polymer design is pressed against an ink pad and then pressed onto the eyebrow area of the first eyebrow. Then the polymer design is removed from the acrylic block, attached in a proper position to the opposite side of the acrylic block, re-inked, and applied to the opposite eyebrow area. While this currently available stamp does save some time by removing the need to individually apply hair-like strokes with an eyebrow pencil to imitate natural hair, it suffers from the disadvantage of requiring significant time to position and to attach the polymer eyebrow design to each side of the acrylic block. Additional time may be needed for cleaning between the first and the second eyebrow applications if ink or color from the first eyebrow remains on the transparent acrylic block, thus obscuring the placement view. Furthermore, the rectangular acrylic block requires support from both hands of the user when positioning the polymer eyebrow design in the correct application position, thus parts of the face are obscured by both hands and optimum aesthetic positioning is difficult to achieve.

It would be advantageous to provide an easy to use device which would address the problems of the application of coloring to the eyebrow area in a time-efficient manner, while allowing the user to more fully view the entire face to appraise the effect of the variations of eyebrow placement and to provide for optimal positioning of the eyebrow for the look and style desired.

Accordingly, there is an established need for an eyebrow stamp that is capable of efficiently applying a cosmetic composition of a desired color in a desired eyebrow shape to the eyebrow area while reducing application time, increasing ease of application, and increasing the visibility of the face to allow for precise aesthetic positioning of the applied eyebrow-shaped color.

SUMMARY OF THE INVENTION

The present invention is directed to an eyebrow makeup application device for applying a cosmetic composition of a desired color in a simulated eyebrow design to the eyebrow area of a face. The eyebrow makeup application device includes a handle and an eyebrow-shaped stamp.

The handle is preferably configured with a first handle end comprising a first fastening connection and with a grip section configured to allow a user to comfortably hold the device in the correct position to easily apply the cosmetic composition.

The skin-facing front surface of the stamp has the shape of the desired eyebrow design, with the front surface configured to contact the cosmetic coloring composition and to retain enough of the composition to imprint the desired eyebrow design when the front surface contacts the eyebrow area of the user.

A second fastening connection on the rear base of the stamp is configured to connect the stamp to the handle via the first fastening connection, either permanently or removably.

An object of the present invention is to provide an eyebrow makeup application device that is adapted to imprint a desired eyebrow shape on an eyebrow area.

A further object of the present invention is to provide an eyebrow makeup application device that allows the user to optimally position the eyebrow makeup application device so that the imprinted desired eyebrow shape is aesthetically pleasing.

Another object of the present invention is to provide an eyebrow makeup application device that is adapted for use with a variety of cosmetic coloring compositions.

An additional object of the present invention is to provide an eyebrow makeup application device that is configured to save time in obtaining a desired eyebrow shape over the time required by manual application of the desired eyebrow shape with an eyebrow pencil.

Another object of the present invention is to provide an eyebrow makeup application device that is capable of easily producing symmetrical eyebrow shapes.

A further object of the present invention is to provide an eyebrow makeup application device that is adapted to increase visibility of the face during application of the desired eyebrow shape, thereby improving the ability of the user to determine optimum placement.

These and other objects, features, and advantages of the present invention will become more readily apparent from the attached drawings and from the detailed description of the preferred embodiments, which follow.

BRIEF DESCRIPTION OF THE DRAWINGS

The preferred embodiments of the invention will hereinafter be described in conjunction with the appended drawings, provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

Shown throughout the figures, the present invention is directed toward an eyebrow makeup application device 10 that can be used to quickly and easily apply a cosmetic composition of a desired color in a desired eyebrow design to the eyebrow area 21 of a face.

Figure 1:
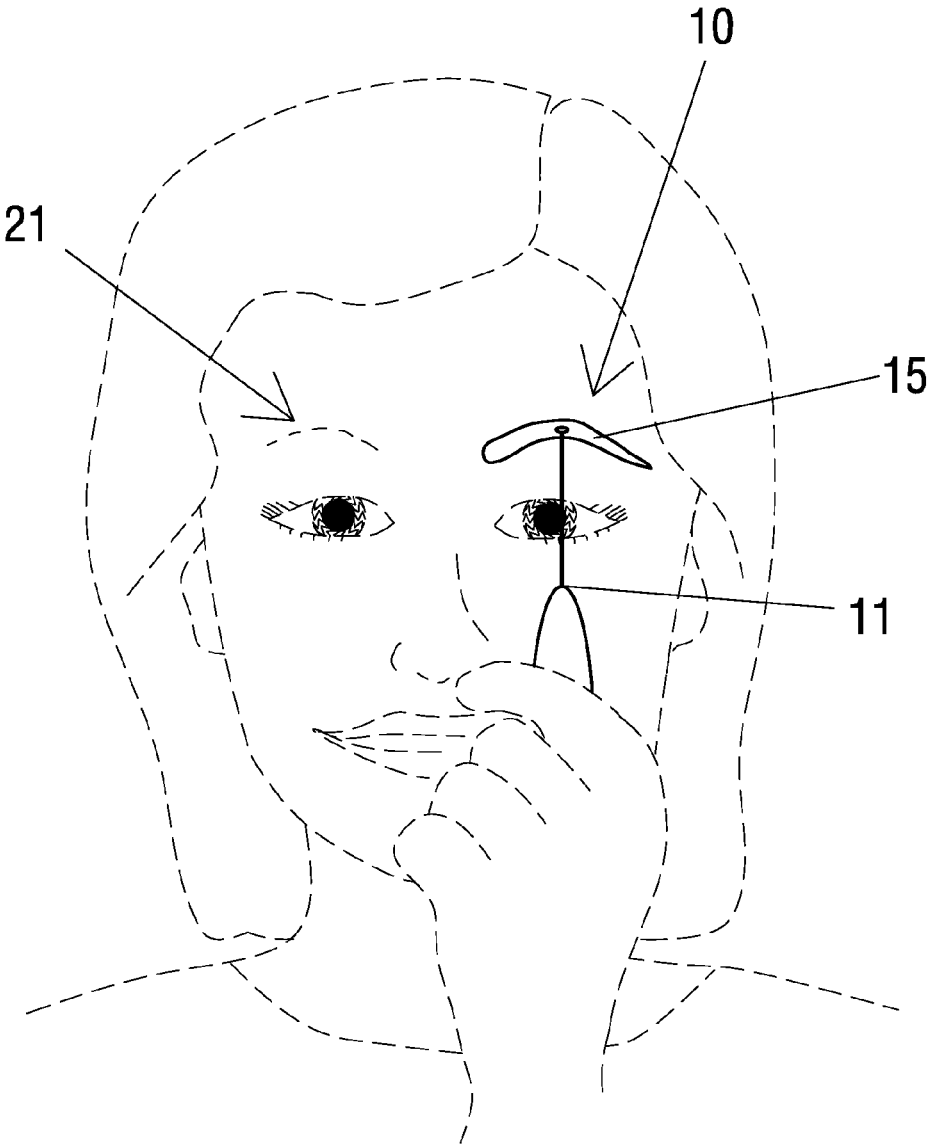
FIG. 1 is a back perspective view showing a first embodiment of the eyebrow makeup application device of the present invention being utilized by a user to apply a desired eyebrow design to an eyebrow area.

Referring now to FIG. 1, the eyebrow makeup application device, shown generally as reference number 10, is illustrated in accordance with a first embodiment of the present invention. As shown, the eyebrow makeup application device 10 includes a handle 11 and a stamp 15, with the first embodiment of FIG. 1 to FIG. 8 providing a permanently attached stamp 15, and with the second embodiment of FIG. 9 to FIG. 10 providing an attachable and removable stamp 15.

Figure 2:
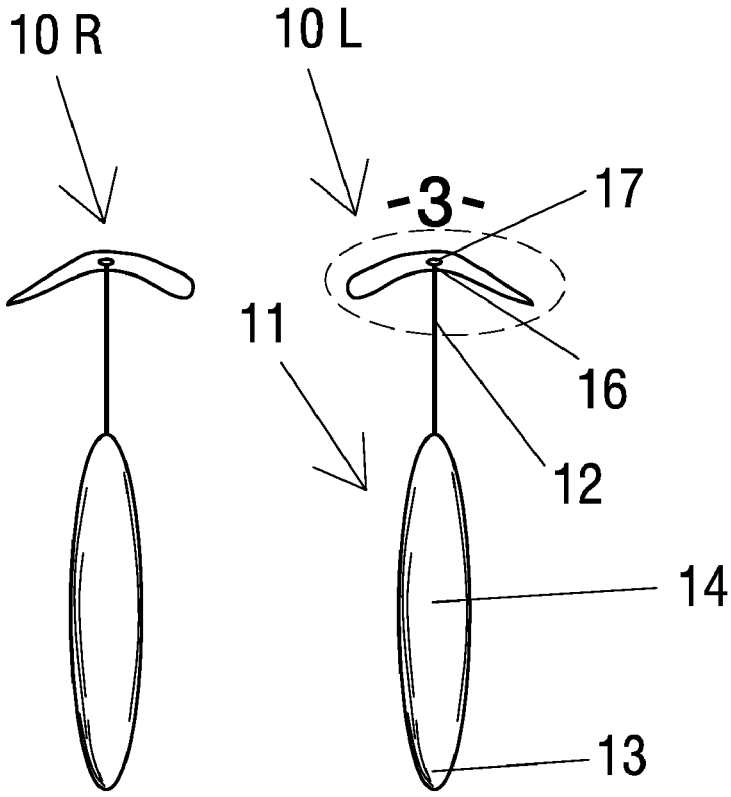
FIG. 2 is a back perspective view showing the first embodiment of the eyebrow makeup application device of the present invention, in a right and left set.
Figure 3:
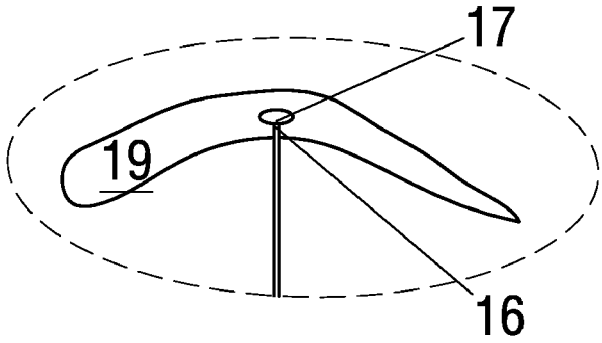
FIG. 3 is a back perspective view showing a detail, of area -3- of FIG. 2, of the back of the stamp portion of the first embodiment of the eyebrow makeup application device of the present invention.
Figure 4:
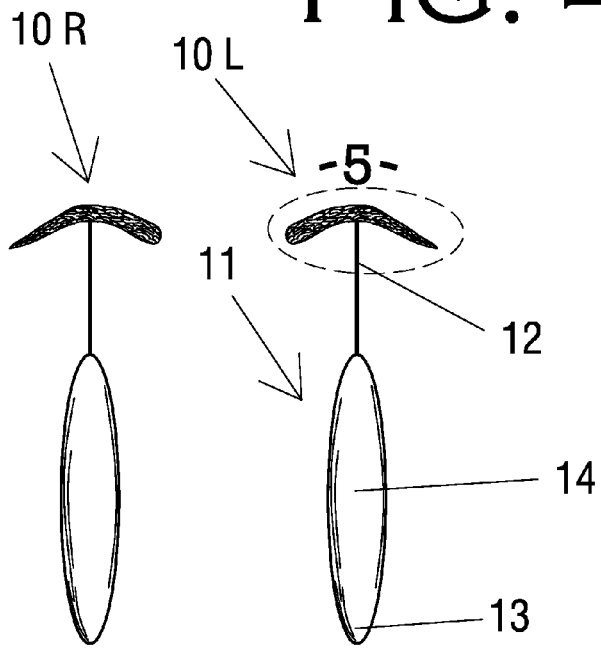
FIG. 4 is a front perspective view showing the preferred embodiment of the eyebrow makeup application device of the present invention, in a right and left set.
Figure 5:
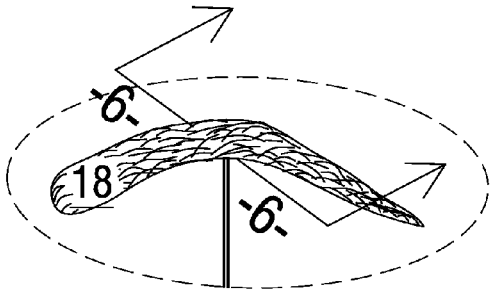
FIG. 5 is a front perspective view showing a detail, of area -5- of FIG. 4, of the skin-facing front surface of the stamp portion of the first embodiment of the eyebrow makeup application device of the present invention.

Shown in greater detail in FIG. 2 and FIG. 3, handle 11 comprises a distal first handle end 12, a proximal second handle end 13, and a grip section 14 disposed between the first handle end 12 and the second handle end 13. Distal first handle end 12 extends generally upward toward the eye area, when in use.

Figure 8:
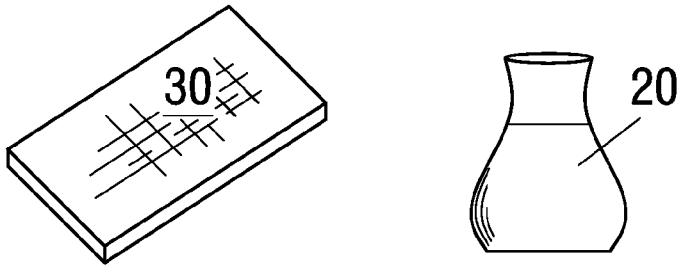
FIG. 8 is a perspective view showing a stamp pad and a cosmetic coloring composition for use with both the first and the second embodiment of the eyebrow makeup application device of the present invention.

The grip section 14 is sized, shaped, and configured to allow a user to comfortably hold the eyebrow makeup application device in a correct and convenient position to easily apply a cosmetic coloring composition 20 (FIG. 8). Grip section 14 may be shaped in any number of generally cylindrical shapes, such as the rounded elliptical shape illustrated. The proximal second handle end 13 extends generally downward from the hand as the hand holds the grip section of the handle when the eyebrow makeup application device is in use. The second handle end 13 is preferably rounded or blunted for safety.

The elongated first handle end 12 extends outward from the grip section 14, providing the location for the attachment of the stamp 15. The first fastening component (FIG. 3) is disposed at the distal section of first handle end 12 and is configured allow permanent attachment to the second fastening component 17 (FIG. 3) of stamp 15. First handle end 12 has sufficient strength to support the stamp 15 that is attached to the first fastening component 16, yet is preferably narrow to obscure less of the face, providing a clear viewing area for optimum aesthetic application of the cosmetic composition with the eyebrow makeup application device 10. Most preferably first handle end 12 is configured as a cylindrical rod.

The parts of handle 11 may be formed from one or more of a variety of materials, such as wood, plastic, or metal, as dictated by considerations of ergonomics, economics, processing convenience, product usability, aesthetics, and the like. It is anticipated that handle 11 would most economically be unitarily molded from plastic or other synthetic or semi-synthetic polymers. Alternatively, grip section 14 and second handle end 13 may be formed of a plastic or wood with first handle end 12 formed of metal and non-removably joined to grip section 14. Another, perhaps more elegant, option would be to form grip section 14 of a visually appealing wood and to form both the second handle end 13 and the first handle end 12 of a decorative metal or metal alloy.

The stamp 15 has a front surface 18 (FIG. 5) and a rear base 19 (FIG. 3). Front surface 18 is preferably formed of a sheet of a somewhat flexible material, such as rubber or a synthetic rubber-like material, with the desired eyebrow design 25 carved, molded, laser engraved, or vulcanized onto the front surface 18. The front surface 18 is adapted to contact a cosmetic coloring composition 20 (FIG. 8), configured to retain a sufficient amount of the cosmetic coloring composition 20, and configured to imprint the desired eyebrow design onto the eyebrow area 21 of either the right or left eye. The rear base 19 is configured with a generally centrally located second fastening component 17.

Figure 6:
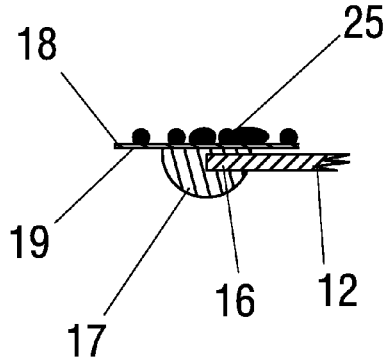
FIG. 6 is an enlarged cross-sectional view taken along the line -6- of FIG. 5, showing the stamp portion of the first embodiment of the eyebrow makeup application device of the present invention.
Figure 7:
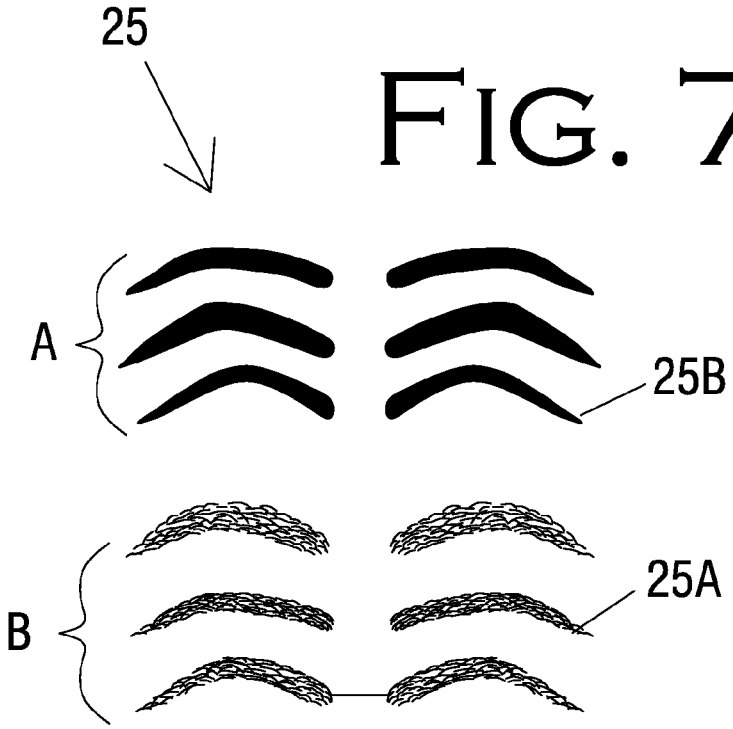
FIG. 7 is a front view showing a variety of eyebrow designs for use with both the first and the second embodiment of the eyebrow makeup application device of the present invention.

The front surface 18 comprises an aesthetically pleasing eyebrow design 25 (FIG. 6, FIG. 7). Preferably a multiplicity of eyebrow designs 25 are provided; thus the user can choose a desirable or suitable eyebrow design for the occasion or the situation. The eyebrow designs that may be provided include a variety of eyebrow outlines, shapes, arch heights, varying eyebrow widths, and varying eyebrow lengths, as well as including a variety of textures. For example, a more reserved eyebrow shape (design 25A) might be preferred for daytime office work, while a more glamorous or trendier eyebrow shape (design 25B) might be preferred for an evening event. Shapes with higher arches, as in design 25B, as well as lower arches, as in design 25A, are provided. Additionally, the variety of eyebrow designs 25 range from thicker or thinner hair textures (Group B, FIG. 7) to fanciful designs or other designs that are not representational of hair textures, such as the solid designs 25 of Group A, FIG. 7.

Preferably the textures of the eyebrow design 25 disposed on the front stamp surface 18, along with front stamp surface 18, are formed unitarily with the rear base 19 of stamp 15, but alternatively some or all of the front stamp surface 18 (or textures thereof) may be formed separately and then non-removably attached to rear base 19. Rear base 19, preferably formed of metal, plastic, or a rubber or a synthetic rubber-like material, is configured to lend support to both the front stamp surface 18 and to the second fastening component 17.

In the first exemplary embodiment, the second fastening component 17 (FIG. 6), disposed on the rear base 19, is configured to non-removably attach to the first fastening component 16 of first handle end 12 of handle 11, preferably at the time of manufacture. The second fastening component 17 may be formed unitarily with rear base 19 or formed separately and permanently joined to rear base 19.

Preferably the second fastening component 17 is configured with a receiving area configured to slidingly engage first fastening component 16. First fastening component 16 is then slidingly engaged with the complementary receiving area, with or without the benefit of an adhesive. Preferably the receiving area is reinforced to be sufficiently strong to support stamp 15 on handle 11. However, any fastening modality as is known in the art is within the scope of the invention, such as, for example, mechanical fasteners, adhesive fasteners, rivets, welding, clamps, or the like. Since in this first embodiment stamp 15 is permanently mounted on handle 11, the eyebrow makeup application device 10 will be provided to the user in left and right mirror image pairs (10 R and 10 L of FIG. 2, FIG. 4).

When using the eyebrow makeup application device 10, a suitable amount of the cosmetic coloring composition (FIG. 8) is applied to color the eyebrow design 25 on front stamp surface 18 before application of the cosmetic coloring composition 20 to the eyebrow area 21. Any of a number of available cosmetic coloring compositions 20 can be utilized without departing from the present invention, such as, for example, currently available mascara compositions in liquid, gel, or powder formats or available eye brow liquids, gels, or powders. The cosmetic coloring composition 20 can vary in color from naturally occurring eyebrow colors to non-natural colors, thereby allowing the user to match or contrast his or her eyebrow color with his or her hair color. For example, an iridescent blue cosmetic coloring composition 20 might be chosen to contrast with iridescent pink hair for an exotic look. Additionally, the cosmetic coloring composition 20 may further comprise glitter, sparkles, or other shimmering components to add an element of flashiness or glitz to the eyebrow design applied with the eyebrow makeup application device 10.

In general, for convenience, conservation of product, and cleanliness of application of the cosmetic coloring composition 20 to the front stamp surface 18, preferably a stamp pad 30 (FIG. 8) is embedded with a liquid cosmetic coloring composition 20. However, for applications in which glittery components are desired to be added to the eyebrow design, a small bottle containing the cosmetic coloring composition 20 with glittery components may be beneficially provided. In that circumstance, immediately before use, the user preferably shakes the bottle to bring the glittery components into suspension and then pours a small amount of the cosmetic coloring composition 20 with glittery components into a flat container or onto stamp pad 30. At that point the user would contact the front stamp surface 18 with the surface of the stamp pad 30 or with the liquid in the flat container. The front stamp surface 18 is configured to retain a sufficient amount of the cosmetic coloring composition 20 so that when the front stamp surface 18 is pressed against the eyebrow area 21 of the user's face a satisfactory amount of the cosmetic coloring composition 20 is imprinted on the eyebrow area 21 to achieve the eyebrow design desired.

Alternatively, but less preferably, the cosmetic coloring composition 20 may be provided in a loose powder form. The powder form of the cosmetic coloring composition would be dispensed into a small flat container into which the front stamp surface 18 could be dipped to retain a sufficient amount of the powdered form of the cosmetic coloring composition 20 to form the desired eyebrow design when applied to the eyebrow area 21.

To utilize the eyebrow makeup application device of the present invention, the user first selects the desired eyebrow design 25. This determination may take into consideration any or all of the following factors: the shape of the user's face, an upcoming event or situation, the attitude or temperament that the user desires to imply, the current absence or presence of natural eyebrow hair, the natural eyebrow shape, the natural eyebrow thickness, the natural eyebrow size, facial bone structure, hair color, hair style, and similar factors.

After the desired eyebrow design is selected, the user obtains the eyebrow makeup application device 10 with the desired eyebrow design. The user also selects and obtains the cosmetic coloring composition 20 in the type and color desired.

Optionally, the user may prepare the eyebrow area for application of the desired eyebrow design by the eyebrow makeup application device 10. This preparation may include any or all of the following steps: removal of all of the natural eyebrow hair through temporary or permanent measures, partial removal of natural eyebrow hair through temporary or permanent measures, shaping of natural eyebrow hair through temporary or permanent measures, cleansing the eyebrow area 21, treating the skin of the eyebrow area 21 with moisturizing products, applying smudge-preventative cosmetic products to the eyebrow area 21, or the like.

Then, the user presses the front stamp surface 18 onto the surface of stamp pad 30 in a manner that allows the front stamp surface 18 to become embedded with an adequate amount of cosmetic coloring composition 20.

Looking into a mirror, the user, holding onto handle 11, positions the eyebrow makeup application device 10 with the front stamp surface 18 facing the eyebrow area 21 and adjusts the precise positioning until the placement looks aesthetically pleasing.

The front stamp surface 18 embedded with the cosmetic coloring composition 20 is then gently placed against the skin. A rolling motion may be used, if needed to assure that all areas of the front stamp surface 18 come into contact with the skin of the eyebrow area 21.

The user will then repeat the steps for the other side of the face, using the mirror image eyebrow makeup application device 10.

Optionally, the user can review the placement of the simulated eyebrow designs. If changes need to be made, the user can use eye makeup remover to remove the newly applied eyebrow design and can repeat the steps to obtain a more perfect result.

Figure 9:
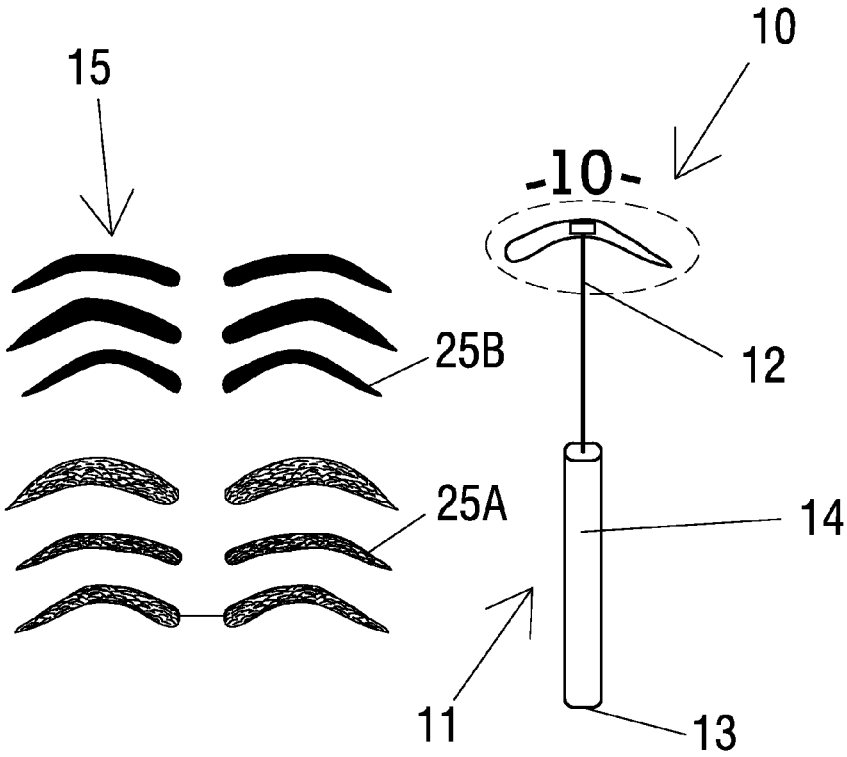
FIG. 9 is a back perspective view showing the second preferred embodiment of the eyebrow makeup application device of the present invention.
Figure 10:
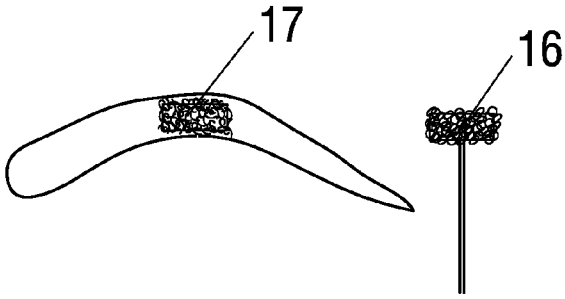
FIG. 10 is a perspective view showing a detail, of area -10- of FIG. 9, of the back of the stamp portion and of the front of the handle portion of the second preferred embodiment of the eyebrow makeup application device of the present invention.

FIG. 9 and FIG. 10 illustrate a second preferred exemplary embodiment of the eyebrow makeup application device 10 of the present invention. The second exemplary embodiment of the eyebrow makeup application device 10 is similar to, and functions in a similar manner to, the first exemplary embodiment of FIG. 1 to FIG. 6, but additionally demonstrates a more cylindrical handle, one of many possible variations in handle shape, as well as providing an attachable handle 11 that is attachable to and removable from stamp 15. In the second exemplary embodiment the second fastening component 17, disposed on the rear base 19, is configured to removably attach to and detach from the first fastening component 16 of handle 11. First fastening component 16 and second fastening component 17 may comprise any complementary fasteners as are known in the art. For example, first fastening component 16 and second fastening component 17 can comprise complementary hook and loop fasteners (as illustrated in FIG. 9 and FIG. 10), complementary snap fit fasteners, a screw and a complementary threaded receiver, a button and slot type system, other mechanical fasteners, or complementary magnetic fasteners. Alternatively, first fastening component 16 and second fastening component 17 can be removably slidingly engaged, similar to the non-removable engagement illustrated in FIG. 6, with the end of first handle end 12 presenting a rod-type projection to be slidingly engaged with a complementary receiving area.

The removably attachable functionality provided by the second embodiment of the eyebrow makeup application device 10 enables the user to manually attach any one of a variety of provided stamps 15 (having various eyebrow designs such as design 25A or design 25B) to a single handle. A single handle 11 with removably attachable stamps is economical, versatile, and more compact. Especially for a user with numerous eyebrow stamps 15, storage space would be conserved compared to the storage space required for numerous eyebrow makeup application devices 10 with the non-detachable stamp 15 and handle 11 of the first embodiment.

The second exemplary embodiment is utilized in the same manner as the first exemplary embodiment with the additional step of fastening the desired attachable stamp to the attachable handle 11 by connecting first fastening component 16 to second fastening component 17.

From the foregoing, it will be apparent that the eyebrow makeup application device 10 of the current invention provides a time-saving device that allows the user to optimally position the eyebrow makeup application device to imprint a desired aesthetically pleasing simulated eyebrow design.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

I claim:

1. A device for applying a cosmetic coloring composition to the eyebrow area of a face, comprising:

a handle having an elongated first handle end, a second handle end, and an elongated grip section positioned between said first handle end and said second handle end, wherein said first handle end is connected to a shaft such that a first fastening connection is disposed distally on said shaft having a substantially smaller diameter that said grip section and is configured to only minimally restrict visibility when said shaft is held to an eyebrow area;

an eyebrow-shaped stamp comprising a skin-facing front surface and a rear surface, wherein said rear surface comprises a generally centrally located second fastening connection configured to connect to said first fastening connection, and said front surface is configured with a desired eyebrow design; and wherein said eyebrow-shaped stamp is configured to retain a sufficient amount of said cosmetic coloring composition after manually being contacted with said cosmetic coloring composition to deposit at least a part of said sufficient amount of said cosmetic coloring composition on said eyebrow area to imprint the desired eyebrow design.

2. The device for applying a cosmetic coloring composition in a desired eyebrow design to the eyebrow area of a face, as recited in claim 1, wherein said second fastening connection is configured to non-removably connect to said first fastening connection.

3. The device for applying a cosmetic coloring composition in a desired eyebrow design to the eyebrow area of a face, as recited in claim 2, wherein said shaft is formed of metal.

4. The device for applying a cosmetic coloring composition in a desired eyebrow design to the eyebrow area of a face, as recited in claim 2, wherein said shaft is formed of plastic.

5. The device for applying a cosmetic coloring composition in a desired eyebrow design to the eyebrow area of a face, as recited in claim 2, wherein said grip section is formed of wood.

6. The device for applying a cosmetic coloring composition in a desired eyebrow design to the eyebrow area of a face, as recited in claim 2, wherein said grip section is formed of plastic.

7. The device for applying a cosmetic coloring composition in a desired eyebrow design to the eyebrow area of a face, a recited in claim 1, wherein said second fastening connection is configured to removably connect to said first fastening connection.

8. The device for applying a cosmetic coloring composition in a desired eyebrow design to the eyebrow area of a face, as recited in claim 7, wherein said second fastening connection comprises one of a set of complementary hook and loop fasteners and said first fastening connection comprises the other of said set of complementary hook and loop fasteners.

9. The device for applying a cosmetic coloring composition in a desired eyebrow design to the eyebrow area of a face, as recited in claim 7, wherein said first handle end is formed of metal.

10. The device for applying a cosmetic coloring composition in a desired eyebrow design to the eyebrow area of a face, as recited in claim 7, wherein said first handle end is formed of plastic.

11. The device for applying a cosmetic coloring composition in a desired eyebrow design to the eyebrow area of a face, as recited in claim 7, wherein said grip section is formed of wood.

12. The device for applying a cosmetic coloring composition in a desired eyebrow design to the eyebrow area of a face, as recited in claim 7, wherein said grip section is formed of plastic.

13. The device for applying a cosmetic coloring composition in a desired eyebrow design to the eyebrow area of a face, as recited in claim 7, wherein said second handle end is formed of metal.

14. The device for applying a cosmetic coloring composition in a desired eyebrow design to the eyebrow area of a face, as recited in claim 7, wherein said desired eyebrow design comprises an arched eyebrow shape.

15. The device for applying a cosmetic coloring composition in a desired eyebrow design to the eyebrow area of a face, as recited in claim 7, wherein said desired eyebrow design comprises a thickly textured eyebrow shape.

16. A method to use an eyebrow makeup application device for applying a cosmetic coloring composition in a desired eyebrow design to the eyebrow area of a face, comprising:

providing an eyebrow makeup application device comprising a handle and an eyebrow-shaped stamp connected by an elongated shaft such that the shaft includes a first fastening connection that is disposed distally thereon for connection to a rear surface of said eyebrow makeup application device, with said stamp comprising a skin-facing front surface configured with the shape of said desired eyebrow design and with said handle comprising a grip section and an elongated rod-like first handle end, wherein said shaft has a substantially smaller diameter than said grip section and only minimally restricts visibility when said eyebrow makeup application device is held to said eyebrow area;

contacting said front surface with said cosmetic coloring composition;

manually positioning said front surface in front of said eyebrow area; and contacting said front surface with said eyebrow area, whereby a sufficient amount of said cosmetic coloring composition is deposited on said eyebrow area.

17. A method to use an eyebrow makeup application device for applying a cosmetic coloring composition in a desired eyebrow design to the eyebrow area of a face, comprising:

providing a handle comprising a grip section configured for manually holding said handle and an elongated shaft having a substantially smaller diameter that said grip section so as to only minimally restrict visibility when using said eyebrow makeup application device, said shaft comprising a distally disposed first fastening connection;

providing at least one eyebrow-shaped stamp comprising a skin-facing front surface configured with the shape of said desired eyebrow design and comprising a second fastening connection on a rear facing surface configured to attach to said first fastening connection;

connecting said handle to said eyebrow-shaped stamp by attaching said second fastening connection to said first fastening connection;

contacting said front surface with said cosmetic coloring composition;

manually positioning said front surface in front of said eyebrow area; and contacting said front surface with said eyebrow area, whereby a sufficient amount of said cosmetic coloring composition is deposited on said eyebrow area.

18. The method to use an eyebrow makeup application device for applying a cosmetic coloring composition in a desired eyebrow design to the eyebrow area of a face as recited in claim 17, further comprising:

providing a second of said one or more eyebrow-shaped stamps;

disconnecting said first one of said one or more eyebrow-shaped stamps from said handle by disengaging said second fastening connection from said first fastening connection;

connecting said handle to said second of said one or more eyebrow-shaped stamps by attaching said second fastening connection to said first fastening connection.

19. The method to use an eyebrow makeup application device for applying a cosmetic coloring composition in a desired eyebrow design to the eyebrow area of a face as recited in claim 18, further comprising:

manually rolling said front surface in contact with said eyebrow area to produce a more defined said desired eyebrow design by application of said cosmetic coloring composition.

* * * * *

UNITED STATES PATENT AND TRADEMARK OFFICE

CERTIFICATE OF CORRECTION

PATENT NO. : 8,051,860 B1
APPLICATION NO. : 12/123007
DATED : November 8, 2011
INVENTOR(S) : Suely Pereira It is certified that error appears in the above-identified patent and that said Letters Patent is hereby corrected as shown below:

Column 4
line 50 “component (FIG. 3)” should be -- component 16 (FIG. 3) --.

Column 5
lines 66-67 “composition (FIG. 8)” should be -- composition 20 (FIG. 8) --.

Column 6
line 41 “composition would” should be -- composition 20 would --.
line 47 “device of” should be -- device 10 of --.
line 61 “area for” should be -- area 21 for --.

Column 7
line 67 “stamp to” should be -- stamp 15 to --.

Column 8
claim 1, lines 23-24 “diameter that said” should be -- diameter than said --.

Column 10
claim 17, line 9 “diameter that said” should be -- diameter than said --.

Signed and Sealed this
Fourteenth Day of February, 2012

David J. Kappos

David J. Kappos
*Director of the United States Patent and Trademark Office*